US007156210B2

(12) United States Patent
Reynolds et al.

(10) Patent No.: US 7,156,210 B2
(45) Date of Patent: Jan. 2, 2007

(54) FREIGHT ELEVATOR LANDING DOOR CONTROL

(75) Inventors: Steven P. Reynolds, Toronto (CA); Richard W. Lajeunesse, Brampton (CA); Zygmunt Dziwak, Mississauga (CA); David E. Kairis, Brampton (CA)

(73) Assignee: The Peelle Company Ltd., Brampton (CA)

( * ) Notice: Subject to any disclaimer, the term of this patent is extended or adjusted under 35 U.S.C. 154(b) by 374 days.

(21) Appl. No.: 10/373,291

(22) Filed: Feb. 24, 2003

(65) Prior Publication Data

US 2004/0168863 A1 Sep. 2, 2004

(51) Int. Cl.
*B66B 13/14* (2006.01)
*B66B 13/26* (2006.01)
*B66B 13/02* (2006.01)

(52) U.S. Cl. ..... 187/317; 187/316; 187/318; 187/320; 187/321; 49/120

(58) Field of Classification Search ..... 187/315–318, 187/320, 325, 333; 49/118, 120, 138, 360, 49/366, 370
See application file for complete search history.

(56) References Cited

U.S. PATENT DOCUMENTS 1,378,017 A * 5/1921 Fogal et al. ..... 187/321
1,864,667 A * 6/1932 Peelle ..... 187/320
1,927,559 A * 9/1933 Talen ..... 49/28
1,932,198 A * 10/1933 Talen ..... 318/9
1,943,042 A * 1/1934 Schweig ..... 49/118
1,989,148 A * 1/1935 Peelle ..... 187/316
2,012,440 A * 8/1935 Waldman ..... 187/320
2,014,735 A * 10/1935 Schweig ..... 49/118
2,017,736 A * 10/1935 Schweig ..... 49/118
2,020,336 A * 11/1935 Schwartz ..... 49/120
2,175,906 A * 10/1939 McCormick ..... 49/118
2,235,384 A * 3/1941 Radeeff ..... 187/319
2,275,643 A * 3/1942 Norton et al. ..... 187/320
2,286,003 A * 6/1942 Norton et al. ..... 187/333
2,306,493 A * 12/1942 Norton et al. ..... 49/370
2,500,072 A * 3/1950 Harmon ..... 187/318
2,526,503 A * 10/1950 Raque ..... 49/138
2,579,017 A * 12/1951 Schweig ..... 187/318
2,673,316 A * 3/1954 Doeg et al. ..... 318/46
2,937,867 A * 5/1960 Schweig ..... 49/118
4,750,592 A * 6/1988 Watt ..... 187/394
5,587,565 A * 12/1996 Schroder-Brumloop et al. ..... 187/316
5,878,846 A * 3/1999 O'Donnell ..... 187/318
6,435,315 B1 * 8/2002 Zaharia ..... 187/394

* cited by examiner

*Primary Examiner*—Kathy Matecki
*Assistant Examiner*—Eric E. Pico
(74) *Attorney, Agent, or Firm*—Pearne & Gordon LLP

(57) ABSTRACT

A control system for a motorized freight elevator landing door in which all of the doors in a single line of a hoistway are controlled with one set of proximity sensors carried on the elevator car. The sensors signal a controller that operates electric motors for opening and closing the landing door where the car has stopped. The door operating motors are two speed units and the sensors and controller are arranged to operate the motors at high speed during most of the travel in opening or closing movement and at reduced speed at the end of movement. The controller applies power to the motor for a short period after the door is fully closed or open to stall the motors and thereby dampen any rebound motion.

14 Claims, 3 Drawing Sheets

FREIGHT ELEVATOR LANDING DOOR CONTROL

BACKGROUND OF THE INVENTION

The invention relates to the control of motorized freight elevator doors.

PRIOR ART

Freight elevators, sometimes called cargo lifts or goods lifts are typically arranged with vertically sliding doors at their landings. Commonly, these doors are bi-parting panels or slide up to open panels. The landing doors can be motorized and various techniques are used by different manufacturers to control the opening and closing movement of a landing door.

For example, one system operates by applying a brake to the motor drive when the door is reaching the end of its travel in opening or closing movement. The positioning of the door is detected by switches or like devices mounted on the hoistway or shaft at the landing associated with each door. Such prior art systems, when being installed, require extensive wiring and numerous sensing devices in the shaft to detect the position of each landing door. The sensors can require careful adjustment and the motor drive controls can be troublesome when the sensors are not properly adjusted initially or eventually go out of adjustment through wear.

SUMMARY OF THE INVENTION

The invention provides a system for controlling the operation of motorized freight elevator landing doors. The system reduces the number of sensors needed to determine door position in a line of landings and eliminates the requirement of precise adjustment of any sensors and/or physical contact between the sensors and other components of the system. The system is further simplified by a door motor energization strategy that avoids critical timing or critical position sensing and reliably eliminates bouncing or rebounding of a door panel as it reaches full close or full open position.

As disclosed, the invention departs from a conventional practice where landing door position is detected by a plurality of sensors at each landing and, instead, locates the landing door position sensors on the elevator car. Thus, the same single set of sensors are used for all of the landings in a line served by the elevator car. This reduces installation cost and complexity and improves reliability. In the disclosed embodiment, the landing door position sensors are proximity switches or sensors arranged to detect the approach of a door as it nears its open or closed position. The signals from the proximity sensors are used by a controller to change a door motor speed from fast to slow near the end of opening or closing movement. The controller is arranged to continue to supply power to a door motor and allow it to stall for a short period after the door has come to a stop position to eliminate or suppress any tendency of the door to bounce when it engages an opposing surface at the limits of its motion.

DESCRIPTION OF THE PREFERRED EMBODIMENT

Figure 1:
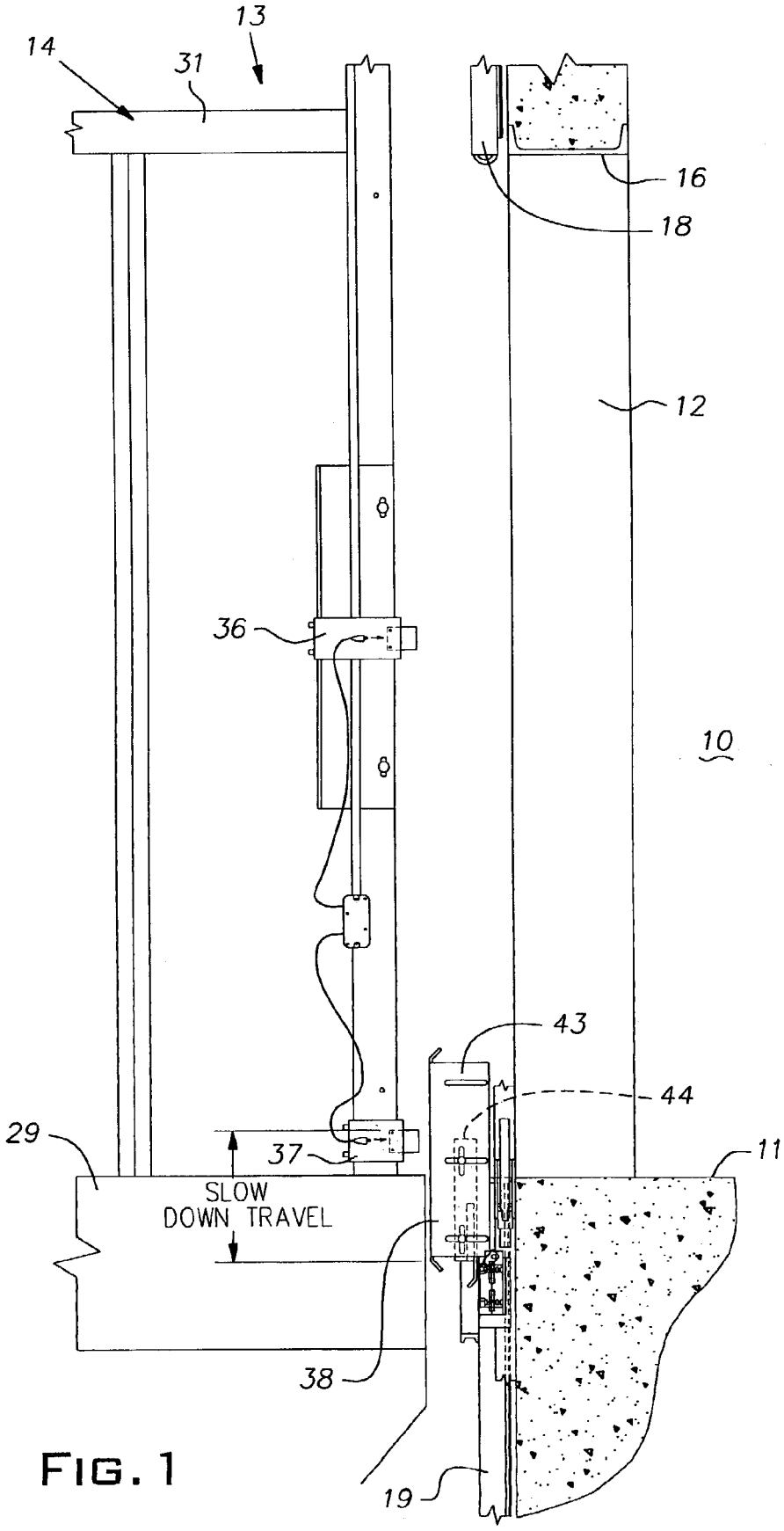
FIG. 1 is a schematic representation of a freight elevator car at a typical landing with a door, shown in an open position, and operated in accordance with the invention.
Figure 2:
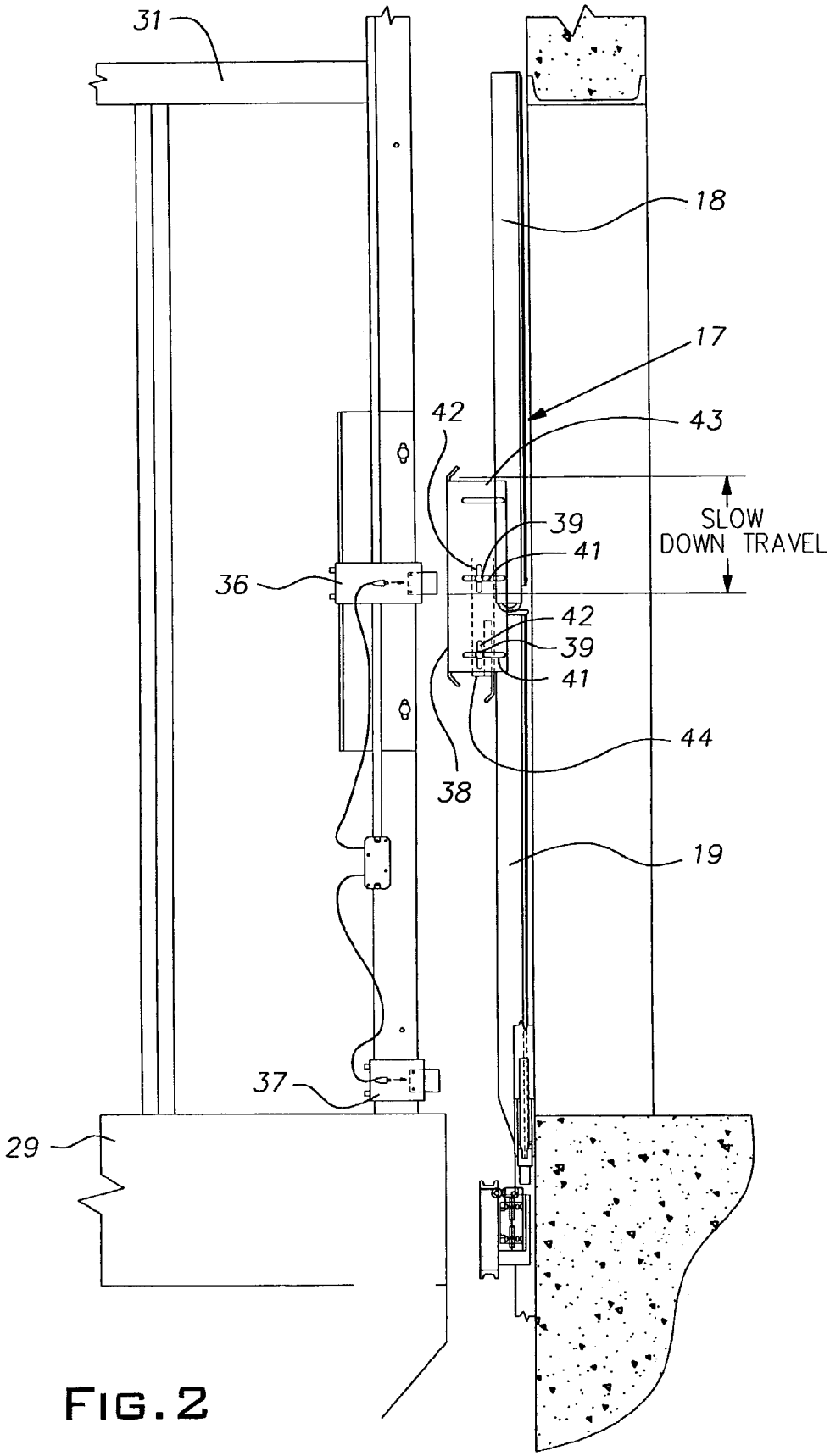
FIG. 2 is a view similar to FIG. 1 with the door in a closed position.

Referring now to FIGS. 1 and 2, a landing 10 is represented by a floor 11. An opening 12 at the landing 10 to a shaft or hoistway 13 of an elevator car 14 is bridged by a lintel 16. The opening 12 is closed or opened with a vertically sliding door 17 that, in the illustrated example, is a bi-parting style having an upper panel 18 and a lower panel 19. The door panels 18, 19 are guided for vertical sliding movement by guide rails (FIG. 3) adjacent both vertical edges of the panels in a known manner. The panels 18, 19 counterbalance one another through roller chains 26 trained over sheaves 27 lying above the vertical edges of the panels. Ends of the chains 26 are anchored to the upper panel 18 and lower panel 19 at points 23, 24, respectively. The sheaves 27 are each rotationally power driven in either direction by an associated electric motor 28.

The elevator car 14 includes a platform 29 and a ceiling 31 shown in FIGS. 1 and 2 for reference purposes. A pair of sensing devices 36 and 37 in the form of non-contact proximity sensors or switches are rigidly mounted on the cab or car 14 preferably outside one of its vertical enclosure walls adjacent the vertical path of the landing door panels 18, 19. One of the sensors 37 is located near the plane of the platform 29 and the other sensor 36 is mounted vertically above the first sensor near the mid-height of the car 14. The proximity sensors 36, 37 are responsive to the near presence of an element 38 in the form of a vertically extending steel plate rigidly fixed on the lower door panel 19 proximal to a common imaginary vertical plane containing the sensors. The plate 38 can be adjusted vertically and horizontally towards and away from the sensors 36, 37 by loosening and tightening screws 39 received in slots 41, 42, respectively, on a leg or flange 43 integral with the plate 38 and on a bracket 44 fixed on the lower door panel 19. The screws 39 secure the plate 38 to the bracket 44 so that it is properly aligned relative to the proximity sensors 36, 37.

Figure 3:
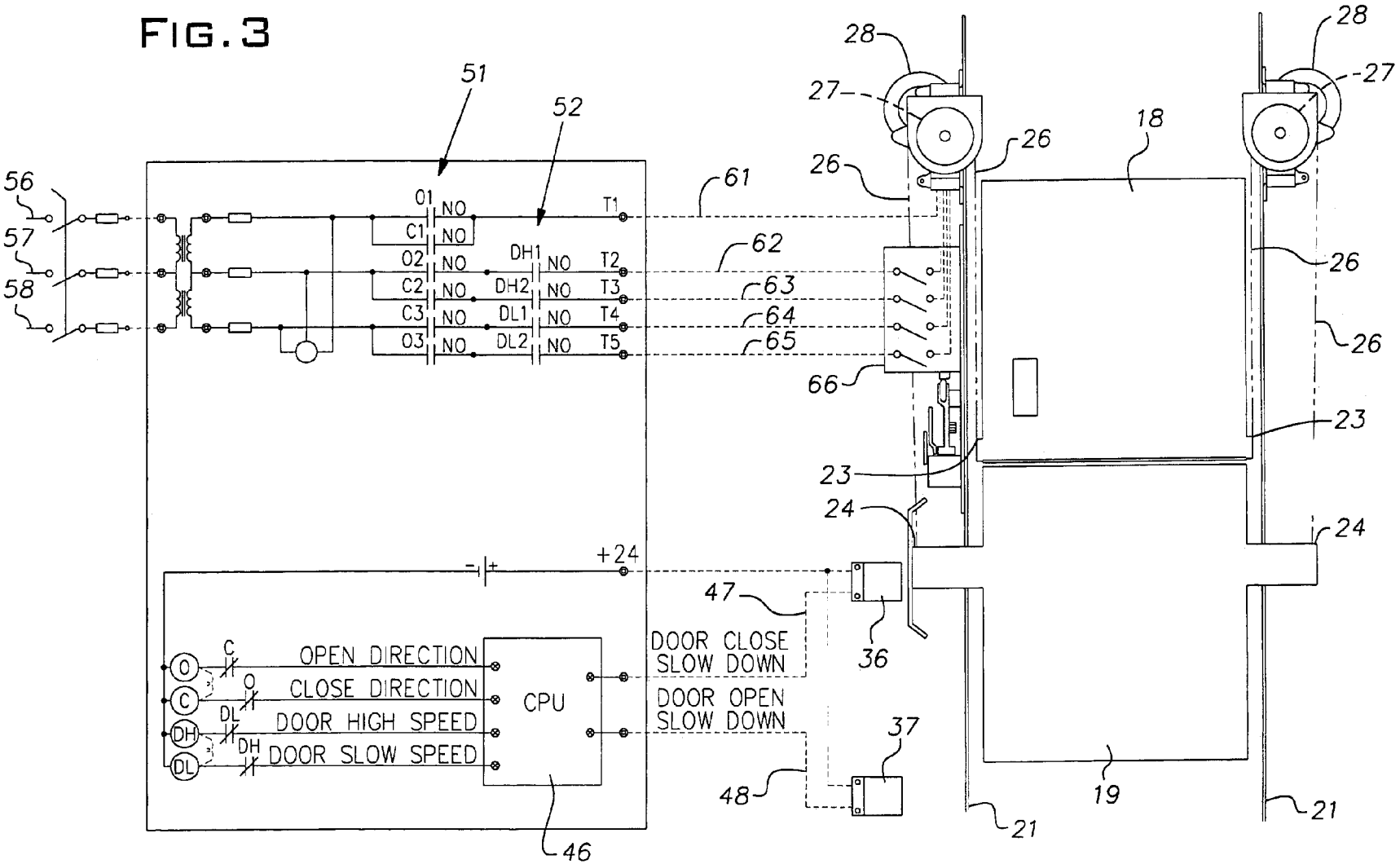
FIG. 3 is a schematic representation of a control circuit for motorized operation of the landing door.

With reference to FIG. 3, the proximity sensors 36, 37 communicate with a programmable logic controller 46 through lines 47, 48, respectively. The controller 46 operates the door motors 28 through banks of relay contacts 51, 52. The first relay contact bank 51 controls, the rotational direction of the motors 28 while the second bank of relay contacts 52 controls the speed of the motors. The operating coils of the relay contacts are indicated at O, C, DH and DL. These relay coils each have normally closed contacts identified by the same letters in series with other ones of the coils to avoid improper relay actuation.

Three-phase power is supplied to the controller 46 at lines 56–58. The controller 46 through the banks of relay contacts 51, 52 supplies power to the landing door motors 28 which are two-speed reversible units, through appropriate combinations of three of five lines 61–65. For simplicities sake, the lines 61–65 are only shown going to the motor 28 on the left in FIG. 3, but it will be understood that the motor 28 on the right is wired in parallel with the motor on the left. A zone switch 66, when properly tripped, enables the operation of the motors 28.

The motorized landing door system operates in the following manner. Assuming the door 17 is open as shown in FIG. 1, a signal such as results from a person pressing a close door button or calling for the car 14 from a landing different from where the car is, causes the controller 46 to energize the motors 28 in a high-speed door closing rotational direction through operation of the relays C, DH. The upper and lower panels 18 and 19 move towards each other in vertical translation at a fast rate. When the lower panel 19 approaches its closed position, the reference plate element 38 moves to a position where it is detected by the proximity sensor or switch 36. This occurs, for example, about 8" before the lower panel 19 reaches its fully closed position at a level where it contacts the lead edge surface of the upper panel 18. The legend "SLOW DOWN TRAVEL" in FIG. 2 illustrates the length or portion of the closing motion of the lower panel 19 during which the proximity sensor 36 senses that the panel is near its fully closed position. When the proximity sensor 36 first senses the proximity of the reference plate 38, it signals the controller 46 through the line 47. At this time, the controller 46 turns off the high speed relay DH and turns on the low speed relay DL to slow the door motors 28 down and avoid a high speed impact with the opposing lead surface of the upper door panel 18. The controller 46, moreover, is programmed to maintain the motors 28 energized with line power for a period long enough for them to stall when the door panels 18, 19 first close on each other and for a short period thereafter to damp out any potential bouncing or rebounding of the door panels.

The controller 46 opens the door panels 18, 19 by operating the motors 28 in a sequence similar to that described when closing the door panel. The controller 46, through the relays O and DH causes the motors 28 to turn in a rotational direction to open the doors at high speed. When the lower panel 19 approaches a full open position, the proximity sensor 37 detects the presence of the lower edge area of the plate 38 and signals the controller 46 through the line 48 that the door is nearing its full open position. The controller 46 responds by energizing the relay DL to cause the motors 28 to operate at slow speed. This slow speed, as before in closing action, reduces impact forces when the door panels reach conventional open position stops. The controller 46 maintains electrical power to the motors 28 for a time period sufficient to ensure that after a door panel 18, 19 reaches a physical stop limiting opening movement, the motors are energized and are allowed to stall to damp any rebound or bouncing of the panels.

It will be understood that the described operation is performed at any landing in a line served by the elevator car 14. The same proximity sensors 36, 37 on the car 14 work with plates or cams like the plate 38 provided on each landing door. The described system, thus, provides an advance over the art where the landing doors at each landing have their own dedicated separately mounted, wired and adjusted position sensors in the hoistway adjacent each landing.

Those skilled in the art will understand that the invention may be applied to single panel doors which, typically, open upwardly from a sill; in such a case, the proximity sensors or their equivalents that detect approach of the door to its fully open position is located near the car ceiling and the sensor detecting a nearly closed door position is located near the platform. Other types of position sensors can be substituted for the non-contact proximity sensors 36, 37 on the car 14 to determine that a landing door or panel is within a predetermined distance from a limit of its motion and to signal the controller of the same. These substitutes can include conventional limit switches or photodetectors, for example. A door panel can be operated in accordance with the invention by a single motor with appropriate mechanical drive, as is known in the art.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A system for motorized operation of a vertically sliding freight elevator door comprising a door panel guided for vertical movement at a landing, a variable speed motor, the motor being connected to raise and lower the door panel, an elevator car, a signal device moveable with the door panel, detecting apparatus on the car, the signal device and the detecting apparatus being constructed and arranged to generate a signal when the door panel is near a fully closed position and when it is near a fully open position, a controller arranged to receive signals generated by said detecting apparatus, said controller being arranged to drive said motor at high speed when the door panel begins to close or open and throughout most of the closing movement and at low speed when the door panel is adjacent its closed or open position.

2. A system as set forth in claim 1, wherein the controller is programmed to power the motor at low speed for a distance that is short compared to its full length of movement and where it maintains electrical power for a period long enough to stall the motor at the fully closed position to damp a tendency of the door panel to rebound from the closed position.

3. A system as set forth in claim 2, wherein the controller is programmed to maintain power to the motor for a short period of time after reaching the fully open position to stall the motor and reduce a tendency of the door panel to rebound from the fully open position.

4. A system as set forth in claim 1, wherein said motor is a two-speed unit.

5. A system as set forth in claim 1, wherein two electric motors are provided to operate said door panel, said door panel having spaced vertical edges and one of said motors being arranged adjacent each one of said vertical edges.

6. A system as set forth in claim 1, wherein the detecting apparatus on the car comprises proximity switches.

7. A system as set forth in claim 1, wherein said door panel is part of a bi-parting door unit having bi-parting sections.

8. A system as set forth in claim 7, wherein the bi-parting sections of said door are arranged to counterbalance one another.

9. A system as set forth in claim 8, including a second variable speed motor, one of said motors being arranged adjacent each vertical edge of said bi-parting section, said motors being connected to operate said door sections through a chain associated with each motor, said chain serving to counterbalance one door section with the other.

10. A system as set forth in claim 7, including two electric motors connected to said bi-parting door sections, one of said motors being connected to vertical edges of said door sections at one end of said door panel and the other of said motors being connected to the other vertical edges of said door sections.

11. A system as set forth in claim 1, wherein the detecting apparatus comprises a pair of detectors, one of said detectors being arranged adjacent the closed position of the door panel and the other of said detectors being arranged adjacent the open position of said door panel.

12. A system as set forth in claim 11, wherein said detectors are proximity switches.

13. A system as set forth in claim 12, wherein the signal device is a vertically extending body having a length in the vertical direction at least as long as the desired slow down travel through which the motor operates at low speed.

14. A system as set forth in claim 13, wherein the signal device is arranged to be detected by both of said proximity switches.

* * * * *